US005873503A

United States Patent [19]

Atherton et al.

[11] Patent Number: 5,873,503

[45] Date of Patent: Feb. 23, 1999

[54] WEIGHT SUPPORT HARNESS

[76] Inventors: Paula Atherton, 80-54 209Str, Hollis Hills, N.Y. 11427; Michael Gibney, 106 Cedar St., Sturbridge, Mass. 01566

[21] Appl. No.: 966,225

[22] Filed: Nov. 7, 1997

[51] Int. Cl.[6] ..... A45F 3/14

[52] U.S. Cl. ..... 224/259; 224/265; 224/910; 84/385 A

[58] Field of Search ..... 224/191, 606, 224/623, 624, 627, 646, 259, 262, 268, 910, 908, 909; 84/385 A, 327; 984/257

[56] References Cited

U.S. PATENT DOCUMENTS

| | | | |
|---|---|---|---|
| 148,744 | 3/1874 | Parent | 224/268 |
| 1,137,303 | 4/1915 | Carpenter | 224/646 |
| 2,441,115 | 5/1948 | Lambert | 224/259 |
| 3,129,863 | 4/1964 | Haugen et al. | 224/910 |
| 4,125,211 | 11/1978 | Handsman | 224/259 |
| 4,630,763 | 12/1986 | Friedman | 224/910 |
| 4,802,613 | 2/1989 | Tierney | 224/910 |
| 5,215,239 | 6/1993 | Walters | 224/259 |
| 5,772,091 | 6/1998 | Lackner | 224/910 |

*Primary Examiner*—Allan N. Shoap
*Assistant Examiner*—Gregory M. Vidovich
*Attorney, Agent, or Firm*—Y. Kateshov

[57] ABSTRACT

A harness for supporting an instrument includes a pair of shoulder straps extending from waist belts and terminating above the person's chest and another strap connected to the pair of shoulder straps and extending therefrom downward to receive a hook assembly for supporting a musical instrument.

7 Claims, 3 Drawing Sheets

WEIGHT SUPPORT HARNESS

FIELD OF THE INVENTION

The present invention relates to a weight support harness and, in particular, to a harness for a musical instrument.

BACKGROUND OF THE INVENTION

An extensive use of a weight harness in general and, particularly, for musical instruments has not undergone substantial modifications since the original one had been used by first musicians. Many of the known harnesses were invented and manufactured without taking into consideration anatomical specifics of a human body.

Thus, for instance, U.S. Pat. No. 5,215,239 discloses a harness for a saxophone which, in many ways, is representative of the products available in the market in this particular field. Traditionally such harness is formed with two shoulder straps extending downwardly to a region of an abdomen where an instrument is removably mounted on a hook which is, in turn, attached to respective ends of the shoulder straps.

Musicians often spend long hours playing the instrument which becomes excessively heavy with time. Because of the two shoulder straps a main load naturally falls on shoulders which tend to bend forward and inward detrimentally affecting thereby a spinal cord as well as a group of back muscles. Such posture of a musician also affects a rib cage limiting an access of air the musician needs while inhaling.

Further, the traditional two strap harness creates additional difficulties for a female musician by pressing against the musician's breast and thereby causing physical inconvenience as well as imparting the quality of a sound.

Finally, since the instrument is always displaceable by the musician, while the latter is playing, a distribution of forces acting upon shoulders is not uniform thereby causing excessive fatigue of one shoulder while leaving the other shoulder underused. Needless to say such unequal distribution of forces also detrimentally affects the musician.

OBJECTS OF THE INVENTION

It is therefore a principle object of the invention to provide a harness overcoming drawbacks of the prior art.

Still another object of the present invention is to provide the harness having a structure relieving a stress upon shoulders.

Yet another object of the present invention is to provide the harness in which the instrument's mass is uniformly distributed over the musician's body

SUMMARY OF THE INVENTION

A harness according to the invention includes belt means for fastening around a waist of a person, belt means being formed with an elongated back support extending symmetrically from a spine cord in opposite directions;

a rubber band mounted on an inner side of the back support, a pair of buckles connected with the opposite ends of the rubber band, a respective pair of waist belts each connected with the respective buckle by a respective one end, and lock means including a lock and a slider received by the lock in a snap-on manner;

a pair of shoulder straps extending over the person's shoulders and having a pair of first ends which are coupled at spaced apart locations with the belt means and a pair of second ends in front of the person and secured to one another and terminating above the person's chest;

a third strap having one of its ends attached to the second ends of the shoulder straps and an opposite end terminating below the person's chest; and hook means for mounting an instrument on the opposite end of the third strap, the shoulder straps being pulled inwardly toward the person's neck upon suspending the instrument on said third strap which extends generally parallel to a spinal cord.

The structure including the third strap allows the musician, while displacing the instrument during performance, to maintain a distribution of forces acting downwardly substantially uniform since the shoulder straps are always symmetrically positioned with respect to the third strap.

The second ends of the shoulder straps terminate in the vicinity of the person's chest. This position is controlled by a pair of slidable locks securing a desirable shoulder strap length. The maximum length of the straps is so designed that the second pair of ends of the shoulder straps can terminate only between the musician's lungs and above the diaphragm.

Each shoulder strap is provided with a respective slidable pad and the respective lock mentioned above. The first ends of the straps are operatively connected with the waist band by means of buckles which flank the back support. The back support is formed with an elastic band which is engaged with a respective pair of buckles at its opposite ends so that the waist band is extendable and can accommodate waists of different sizes.

BRIEF DESCRIPTION OF DRAWING

The above and other objects, features and advantages will become more readily apparent from the following description, references being made to the accompanying drawing, in which.

SPECIFIC DESCRIPTION

Figure 1:
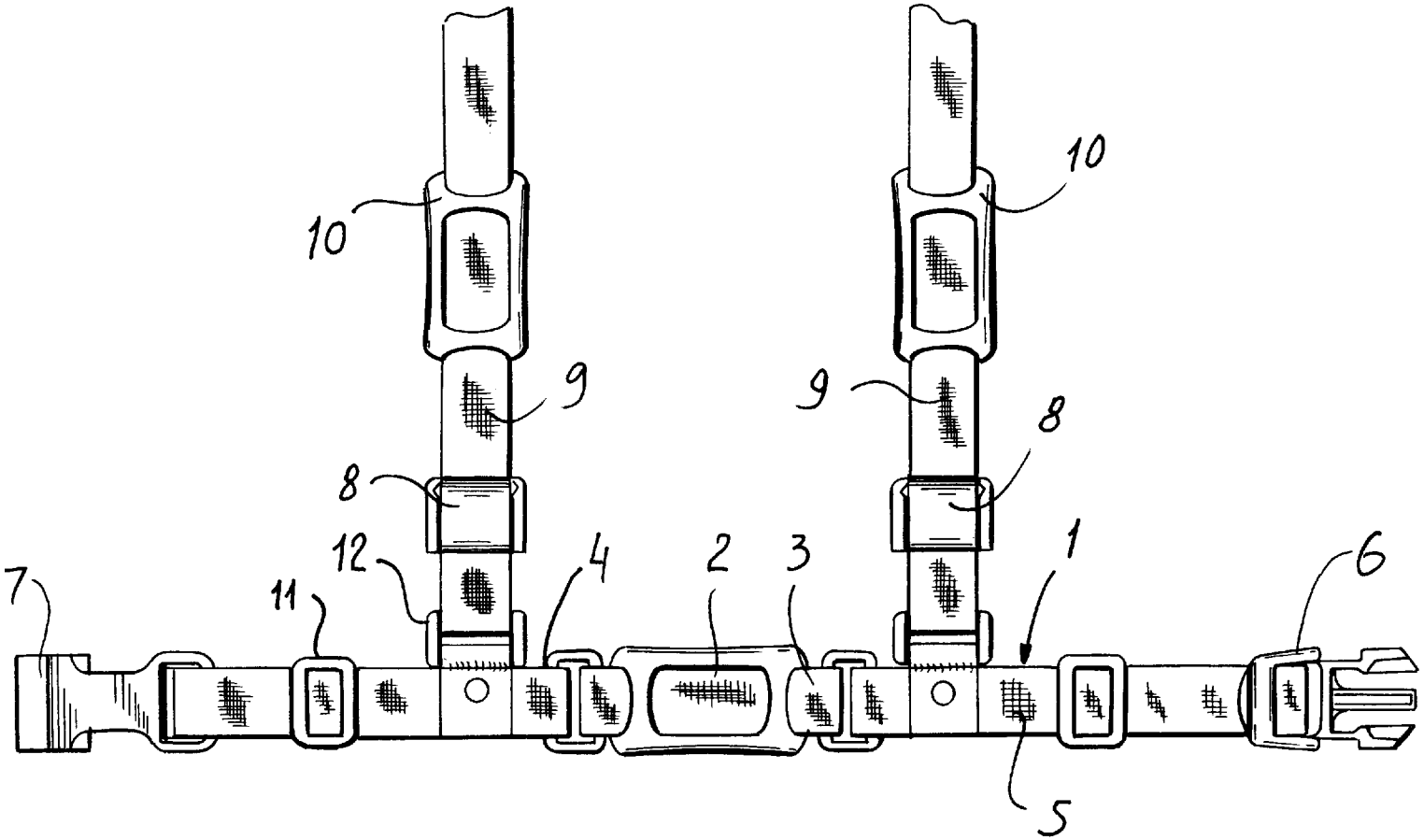
FIG. 1 is a waist band with a pair of the shoulder straps extending from the waist band of the harness according to the invention.

As FIG. 1 illustrates a waist band 1 including a back support 2 formed with a rubber band 3. The opposite ends of the rubber band 3 engage respectively two buckles 4 which, in turn, are connected with respective belt straps 5. The latter are provided with respective buckles 11 and with a lock 6 receiving a slider 7 in the fastening position of the harness.

Two shoulder straps 9, positioned symmetrically with respect to the back support, extend upwardly from the belt straps. Each of the straps is formed with a respective gripper or buckle 8 operatively connected with a buckle 12 engaging, in turn, the respective belt strap and with a respective shoulder pad 10.

Figure 3:
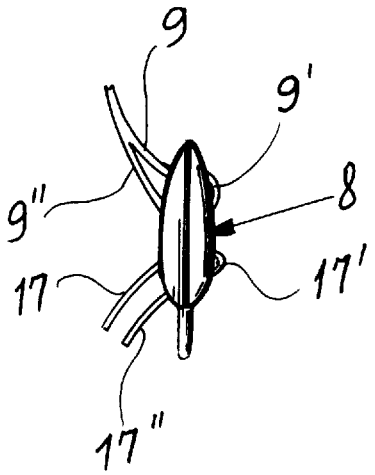
FIG. 3 is a side view of a gripping combination of a back strap according to one embodiment of the invention.

FIG. 3 shows one of the embodiments according to the invention in which the shoulder strap 9 is pulled through the buckle 8 forming a loop 9' and having an end 9" stitched to the strap 9. A strap 17 also formed with a loop 17' on the buckle 8 and connecting the buckles 8 and 12 has a loose end 17" for adjusting a length.

Figure 4:
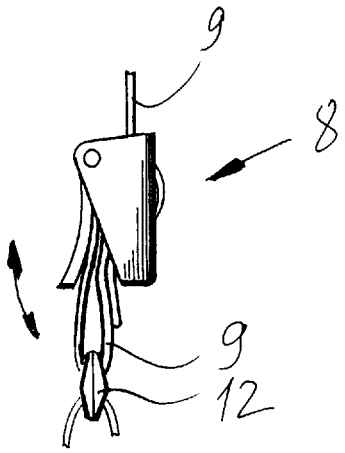
FIG. 4 is a side view of the gripping combination according to another embodiment of the invention.

FIG. 4 and FIG. 1 illustrate another embodiment according to the invention in which the single strip is engaged by the lock 8 and by the buckle 12. Such structure is particularly aesthetically appealing since the shoulder straps do not have loose ends.

Figure 2:
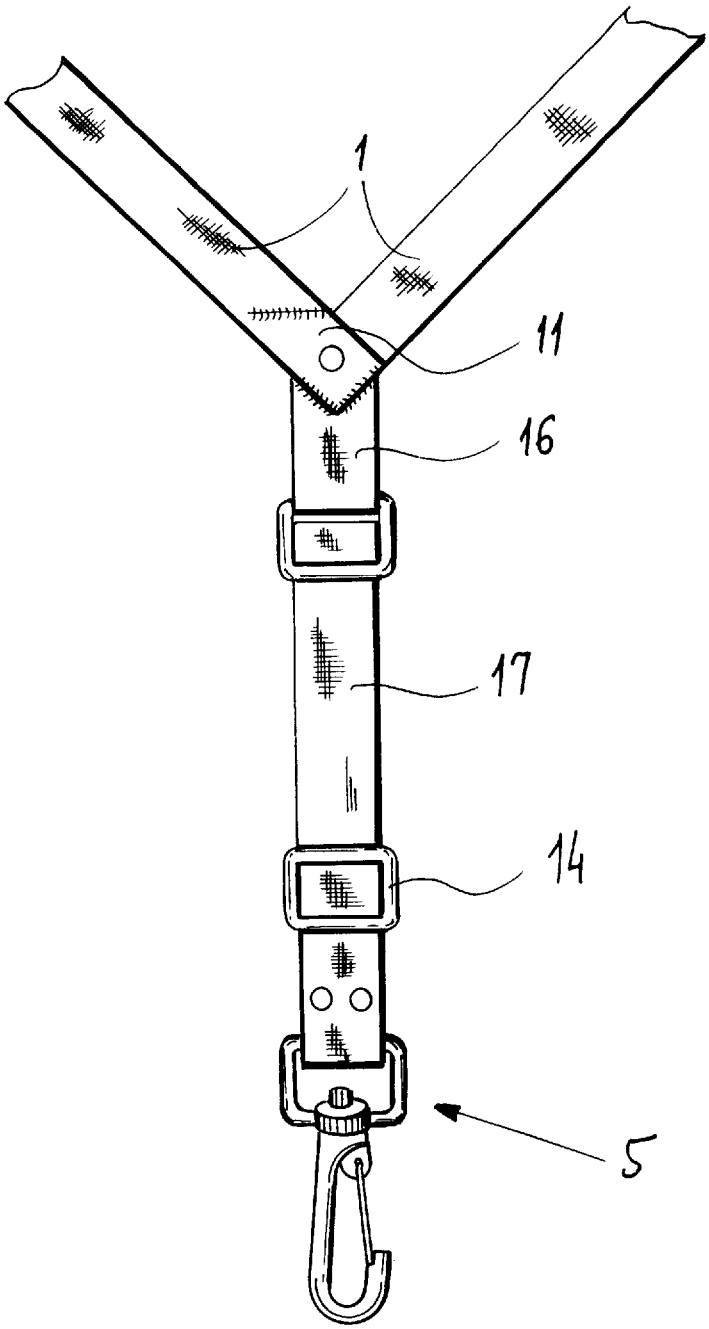
FIG. 2 is a front part of the harness according to the invention.

As is seen in FIG. 2 the shoulder straps are brought together in the vicinity of the chest and connected with a strap 16. The third strap extends generally linearly downwardly between the lungs and engages a buckle 13 which, in turn, is wrapped around by a third strap 17 provided with still another buckle 14 controlling a length of the strap 17.

A lower end of the strap 17 is connected with a hook assembly 15 receiving an instrument.

I claim:

1. A harness for supporting an instrument comprising:

belt means for fastening completely around a waist of a person;

a pair of flaccid shoulder straps for extending over respective shoulders of the person and having a pair of first ends which are operatively connected at spaced apart locations to the belt means and a pair of second ends extending down in front of the person and secured to one another and terminating in the vicinity above the person's chest;

a third strap having one of its ends operatively attached to said second ends of said shoulder straps and an opposite end terminating below the persons chest;

hook means for mounting an instrument on the opposite end of the third strap, said shoulder straps being pulled inwardly toward the person's neck upon suspending the instrument on said third strap which extends generally parallel to a spinal cord.

2. The harness defined in claim 1 wherein said belt means includes:

a back support positioned between said first pair of ends of the shoulder straps, a pair of waist belts each operatively connected with said back support, and lock means for engaging said belt straps with one another around the waist.

3. The harness defined in claim 1 wherein each of said shoulder straps is formed with a respective slidable shoulder pad and a respective gripper slidably mounted on the shoulder strap between the shoulder pad and the belt means.

4. The harness defined in claim 1 wherein the second ends of the shoulder straps are attached to another strap running around a first buckle which is connected with said third strap.

5. The harness defined in claim 4 wherein said third strap is provided with a respective second buckle for regulating a length of the third strap.

6. The harness defined in claim 3 further comprising a pair of fourth straps each briging a respective pair of the slidable gripper and a respective third buckle which engages the belt means.

7. The harness defined in claim 2 wherein the back support is formed with an inner elastic band for adjusting said belt means to different waists.

* * * * *